United States Patent [19]

Brewer et al.

[11] Patent Number: 4,859,410

[45] Date of Patent: Aug. 22, 1989

[54] DIE-UPSET MANUFACTURE TO PRODUCE HIGH VOLUME FRACTIONS OF RE-FE-B TYPE MAGNETICALLY ALIGNED MATERIAL

[75] Inventors: Earl G. Brewer, Warren; Robert W. Lee, Troy, both of Mich.

[73] Assignee: General Motors Corporation, Detroit, Mich.

[21] Appl. No.: 172,666

[22] Filed: Mar. 24, 1988

[51] Int. Cl.[4] ..... G22F 1/00

[52] U.S. Cl. ..... 419/10; 75/244; 419/12; 419/10; 419/66; 252/62.55

[58] Field of Search ..... 419/10, 12, 66; 75/244; 25/62.55

[56] References Cited

U.S. PATENT DOCUMENTS 4,710,239 12/1987 Lee et al. ..... 419/12

4,765,848 8/1988 Mohri et al. ..... 75/244

4,780,226 10/1988 Sheets et al. ..... 419/11

*Primary Examiner*—Stephen J. Lechert, Jr.

*Attorney, Agent, or Firm*—George A. Grove

[57] ABSTRACT

A method to increase the volume fraction of magnetically aligned material in rare earth (RE), iron, boron type anisotropic permanently magnetic material includes forming an adaptively shaped fully dense substantially magnetically isotropic preform from relatively coarse powder particles of melt spun alloy with a very fine grain $Re_2Fe_{14}B$ phase. The preform is heated and die upset to provide uniformity of strain in the perform as it is conformed to the die thereby to cause an increased percentage of the crystallites to be oriented along a crystallographically preferred magnetic axis which increases the energy product of a resultant magnet.

10 Claims, 5 Drawing Sheets

DIE-UPSET MANUFACTURE TO PRODUCE HIGH VOLUME FRACTIONS OF RE-FE-B TYPE MAGNETICALLY ALIGNED MATERIAL

This invention relates to adaptively shaped, magnetically isotropic preforms of finely crystalline alloys containing one or more light rare earth (RE) elements, one or more transition metals (TM) and boron with a Nd-Fe-B type intermetallic phase and configured to define precursors which are hot workable to form an anisotropic permanent magnet product with an increased volume fraction of magnetically aligned material. The invention further relates to a method of hot working such preforms so as to magnetically align most of the particles or crystallites in the preform.

BACKGROUND OF THE INVENTION

Permanent magnet compositions based on the rare earth (RE) elements neodymium or praseodymium or both, the transition metal iron or mixtures of iron and cobalt, and boron are known. Preferred compositions contain a large proportion of a $RE_2TM_{14}B$ phase where TM is one or more transition metal elements including iron. A preferred method of processing such alloys involves rapidly solidifying molten alloy to achieve a substantially amorphous to very finely crystalline microstructure that has isotropic, permanently magnetic properties. In another preferred method, overquenched alloys without appreciable coercivity can be annealed at suitable temperatures to cause grain growth and thereby induce magnetic coercivity. The maximum magnetic energy product to date for such quenched Nd-Fe-B based alloy is about 20 megaGaussOersted.

It is also known that anisotropic permanent magnetic properties can be introduced into rapidly solidified RE-Fe-B based isotropic alloys by hot working. Alloys with overquenched, substantially amorphous microstructures are worked at elevated temperatures to cause grain growth and crystallite orientation which result in substantially higher energy products than in the best as-rapidly-solidified alloys. The maximum energy product to date for hot worked, melt-spun Nd-Fe-B alloy is up to about 50MGOe, although energy products as high as 64MGOe are theoretically possible. However, the volume fraction of the workpiece which is in the higher energy product range has been limited by tool friction effects and unsuitable metal flow produced during the hot working steps.

As stated above, the preferred rare earth (RE)-transition metal (TM)-boron (B) permanent magnet composition consists predominantly of $RE_2TM_{14}B$ grains with a RE-containing minor phase(s) present as a layer at the grain boundaries. It is particularly preferred that on the average the $RE_2TM_{14}B$ grains be no greater than about 500 nm in greatest dimension.

The preferred rare earth elements are Nd and Pr, and the preferred transition metal (TM) is iron or mixtures of iron and cobalt.

The present invention enables highly magnetically anisotropic permanent magnets to be formed. The starting material is formed by initial rapid solidification of the molten alloy but without the fine grinding step of conventional orient, press and sinter processes used in the manufacture of samarium, cobalt and other rare earth permanent magnets. Furthermore, the present invention enables near net-shape magnets to be formed which require less finish grinding.

The present invention uses rapid solidification and subsequent hot compaction to form an initial preform with magnetically isotropic intermetallic phase of Nd-Fe-B. Suitable preforms have basically spherically shaped $RE_2$-$Fe_{14}$-B grains which are randomly oriented in an optimum relationship with rare earth-rich grain boundaries.

It is known that die upsetting improves the maximum energy product of the magnetic material in such preforms by causing the individual particles to orient along a crystallographically preferred axis.

While such die upsetting is suitable for its intended purpose, it has been observed that die upset orientation of the particles often produces less than expected high energy product. The highest alignment (and resulting energy product) occurs only in the volume center of the compact.

This problem is believed to be attributable to substantial friction which develops between the die upset tools and the preform during upsetting thereof with a resultant unsuitable metal flow.

The frictional contact between hot upset rams and die and a workpiece produces a barreling effect in the grain directionality in which the spread of the material at the top, bottom and outer edges of the workpiece is restricted. As a consequence, the material in the workpiece adjacent to the die upset tools undergoes little or no deformation and this effect extends into the workpiece from the opposite ends thereof. As a consequence, there is less strain in parts of the compact than in other parts thereof, and the lesser strained regions produce a lesser volume fraction of the final product with magnetically aligned higher energy products in the range of 35MGOe to 45MGOe.

In one preferred form of the precursor of the present invention, the preforms of magnetically isotropic alloy material with an intermetallic $Nd_2Fe_{14}B$ phase (hereinafter referred to as substantially isotropic 2-14-1 grains) are adaptively configured with respect to the die upset tools such that unsuitable metal flow effects are reduced and a greater volume percent of the precursor experiences a required strain to induce crystallographic alignment as the height of the workpiece is rduced and its shape is altered to conform to the configuration of the die upsetting tool. A resultant precursor with anisotropic permanent magnetic properties is formed having crystallographically aligned platelet shaped $RE_2$–$Fe_{14}$–B grains in an optimum compositional relationship with rare earth-rich grain boundaries. Such grains, on average, are no greater than about 500 nm in the greatest dimension.

Another precursor configuration which is contemplated by the invention is formed from hot die upsettable material of dense substantially isotropic 2-14-1 grains. The precursor has a surface configuration adapted to the shape of a hot working die to cause a greater volume percent of the precursor to experience a strain capable of inducing desired crystallographic alignment to produce higher energy products in the precursor resultant.

Yet another precursor contemplated by the invention is formed of such dense material adaptively configured at surface regions thereon between the opposite ends thereof to provide uniform lateral material flow between the surface regions and the containment die for compressing the precursor during hot die upsetting of the precursor.

Yet another precursor contemplated by the present invention is shaped as an hour glass configuration between opposite ends thereof and which configuration is uniformly laterally deformed during hot die upsetting to conform to a larger diameter cylindrical die to magnetically align the 2-14-1 grains therein parallel to the press direction.

The invention further contemplates a method of hot working such precursors to magnetically align most of the particles or crystallites in the resultant product. The invention also features adaptively shaping a fully dense preform of isotropic 2-14-1 grains into a precursor that conforms to hot working dies to limit friction effects and resultant unsuitable metal flow.

The invention further contemplates an improved method for processing alloy material based on rare earth elements, iron and boron to make isotropic ribbon particles of amorphous or finely crystalline material having grains of $RE_2TM_{14}B$. RE is one or more rare earth elements containing neodymium and/or praseodymium, TM is iron or iron-cobalt combinations and B is the element boron. The improvement comprises compressing the ribbon particles to a fully dense state to form a substantially magnetically isotropic preform and thereafter adaptively shaping the preform to form a precursor with compression relief regions therein and a height to diameter ratio to prevent buckling. The adaptively shaped precursor is then hot die upset to flow the material of the precursor to fill the compression relief regions while maintaining the precursor at an elevated temperature so as to produce uniform strain patterns in the precursor as the precursor is reduced in height and conformed to the die walls. The particles or crystallites thereby become aligned along a crystallographically preferred magnetic axis to increase the magnetic energy product fraction of the total volume of the compressed product. In one preferred method such preferred magnetic axis is parallel to the press direction.

In another preferred method, compression relief regions are formed from a fully dense preform having 2-14-1 grains by shaping a precursor therefrom as a plurality of discs. The discs are stacked end to end in a die cylinder having its containment walls spaced from the outer surface of the discs. A compression force is imposed by plungers against end surfaces of the outermost stacked discs to reduce the height of the discs while causing the outer surfaces thereof to expand uniformly against the die cylinder while compressing the discs to cause the diameter thereof to correspond to that of the die.

Yet another preferred method is to provide hot die upsetting of stacked discs as set forth above, in which the fully dense starting material has a high Nd content. The method includes maintaining a hot pressing temperature during the die upsetting which causes a Nd phase to diffuse to the exterior surfaces of the discs so as to form an in situ lubricant between the discs thereby to produce uniformity of deformation therein during compression thereof.

Another preferred method includes modifying any of the above stated disc stacking methods by shaping the preform of dense isotropic NdFeB material as a right circular cylinder; and thereafter slicing the preform into a plurality of discs. The plurality of discs are then adaptively configured by stacking them with end surfaces thereon in juxtaposed relationship in a die cavity of a diameter greater than that of the stacked discs. The discs are then hot upset to compress the discs to reduce their height and to conform them to the shape of the die cavity so as to uniformly deform and strain the discs to orient 2-14-1 grains therein along the crystallographically preferred magnetic axis.

Yet another method of the present invention includes the step of adaptively shaping an hour glass precursor to provide desired relief for lateal flow of material. In more specific methods, the hour shape is formed either by shaping two conical components each having a small diameter end and a large diameter end and wherein the small diameter ends are stacked with their surfaces in contact at a mid-line or by shaping the hour glass shaped precursor by subjecting a right circular cylinder to etching at the center girth thereof.

BRIEF SUMMARY OF THE PREFERRED EMBODIMENT

Our method is applicable to compositions comprising a suitable transition metal component, a suitable rare earth component, and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth elements, such as samarium, lanthanum, cerium, terbium and dysprosium, may be mixed with neodymium and praseodymium without substantial loss of the desirable magnetic properties. Preferably, they make up no more than about 40 atomic percent of the rare earth component. It is expected that there will be small amounts of impurity elements with the rare earth component.

The composition contains at least 1 atomic percent boron and preferably about 1 to 10 atomic percent boron.

The overall composition may be expressed by the formula $RE_{1-x}(TM_{1-y}B_y)_x$. The rare earth (RE) component makes up 10 to 50 atomic percent of the composition ($x=0.5$ to 0.9), with at least 60 atomic percent of the rare earth component being neodymium and/or praseodymium. The transition metal (TM) as used herein makes up about 50 to 90 atomic percent of the overall composition, with iron representing about 80 atomic percent of the transition metal content. The other constituents, such as cobalt, nickel, chromium or manganese, are called "transition metals" insofar as the above empirical formula is concerned.

Boron is present preferably in an amount of about 1 to 10 atomic percent ($y=0.01$ to 0.11) of the total composition.

The practice of our invention is applicable to a family of iron-neodymium and/or praseodymium-boron containing compositions which are further characterized by the presence or formation of the tetragonal crystal phase specified above, illustrated by the atomic formula $RE_2TM_{14}B$, as the predominant constituent of the material. In other words, our hot worked permanent magnet product contains at least fifty percent by weight of this tetragonal phase.

For convenience, the compositions have been expressed in terms of atomic proportions. Obviously these specifications can be readily converted to weight proportions for preparing the composition mixtures.

For purposes of illustration, our invention will be described using compositions of approximately the following proportions:

$$Nd_{0.13}(Fe_{0.95}B_{0.05})_{0.87}$$

However, it is to be understood that our method is applicable to a family of compositions as described above.

Such compositions are melted to form alloy ingots. The ingots are remelted and sprayed through a discharge nozzle having a small diameter outlet onto a rotating chill surface.

The resultant product is a directly quenched or overquenched alloy ribbon with crystallites or grains within the microstructure having a fairly regular shape. The Nd-Fe-B intermetallic phase has high magnetic symmetry and the directly quenched material (as well as annealed forms of the overquenched material which causes growth of the crystallites) are magnetically isotropic as formed.

Depending on the rate of cooling, molten transition metal-rare earth-boron compositions can be solidified to have microstructures ranging from:

(a) amorphous (glassy) and extremely fine grained microstructures (e.g., less than 20 nanometers in largest dimension) through (b) very fine (micro) grained microstructures (e.g., 20 nm to about 400 or 500 nm) to (c) larger grained microstructures.

Thus far, large grained microstructure melt-spun materials have not been produced with useful permanent magnet properties. Fine grain microstructures, where the grains have a maximum dimension of about 20 to 500 nanometers, have useful permanent magnet properties. Amorphous materials do not. However, some of the glassy microstructure materials can be annealed to convert them to fine grain permanent magnets having isotropic magnetic properties. Our invention is applicable to such overquenched, glassy materials. It is also applicable to "as-quenched" high coercivity, fine grain materials. Care must be taken to avoid excessive time at high temperature to avoid coercivity loss.

In accordance with the present invention, such ribbon formed alloy is broken into coarse powder particles and hot (e.g. 725° C.) precompacted to full density by use of a standard plunger press. The grain size after hot pressing is on the order of 150 nm.

In the past, preforms of such precompacted fully dense ribbon material have been placed in a die upsetting tool and compressed to conform to the die shape under elevated temperature conditions at which the Nd-Fe-B phase is plastically deformed to cause particles or the crystallites themselves to be oriented along a crystallographically preferred magnetic axis with a resultant production of magnetically anisotropic material having greater magnetic energy products than the parent isotropic material.

However, known hot working processes produce substantial friction at the interface between the preform and the hot work tooling. Such friction restricts lateral deformation at the surfaces of the preform and through a portion of the axial length thereof. A resultant barreling effect has been observed which reduces the volume fraction of the resultant magnet in which the material is oriented on a desired crystallographically preferred magnetic axis.

In accordance with the present invention, an increased volume percentage of magnetically aligned material is obtained by adaptively shaping a preform to reduce hot working friction. This precursor is then placed in a die and upset to more uniformly deform the precursor while maintaining an equalized lateral strain in the material to produce a high volume fraction of high energy products in the precursor resultant.

In one embodiment, the preform is adaptively shaped as a donut with its outer diameter slightly less than the diameter of a die cylinder having an upset die plunger therein. The preform is hot upset to compress the donut to a 50% height reduction. Such adaptive shaping shifts poorly aligned material toward the center of the donut and produces greater orientation at the outer diameter of the precursor resultant.

In another embodiment, the preform is adaptively shaped by removing material from the upper and lower edges of a right circular cylindrical preform to form frustoconical ends thereon. The shaped preform is hot upset by a die tool with a die cylinder diameter greater than the precursor diameter. Resultant relief provides a uniform lateral flow of the precursor as it is compressed. This causes increased percentages of high energy products in the precursor resultant.

In yet another embodiment, the preform is adaptively shaped by removing material from the center of a right circular cylinder to form an hour glass shaped precursor with ends engageable by the hot die upset plungers and with a diameter less than that of the die cylinder. The precursor resultant was found to have increased volume fractions with high energy products reflecting desired crystallographic magnetic alignment in the precursor.

An increased volume percentage of magnetically aligned material is also obtained by adaptively shaping the preform as a plurality of stacked discs having the interfaces thereof lubricated by diffusion of an Nd phase to the disc interfaces and wherein the dimensions of the discs are selected with reference to the dimensions of the die upset tooling to prevent buckling of the stacked discs as compressive loading is applied thereagainst by the die plungers.

An advantage of the present invention is that magnetically anisotropic permanent magnets can be hot worked to final shape without resorting to finish machining. Moreover the precursor resultant will have a high percentage of properly magnetically aligned particles therein to increase the high energy product content in predictable regions of the finished product.

These and other objects and advantages of the invention will become more apparent from a detailed description thereof which follows when taken in conjunction with the accompanying drawings wherein:

DETAILED DESCRIPTION OF THE DRAWINGS

DETAILED DESCRIPTION

As stated above, our invention is applicable to high coercivity, fine grain materials comprised of basically spherically shaped, randomly oriented $Nd_2$–$Fe_{14}$-B grains with rare earth rich grain boundaries.

Figure 1:
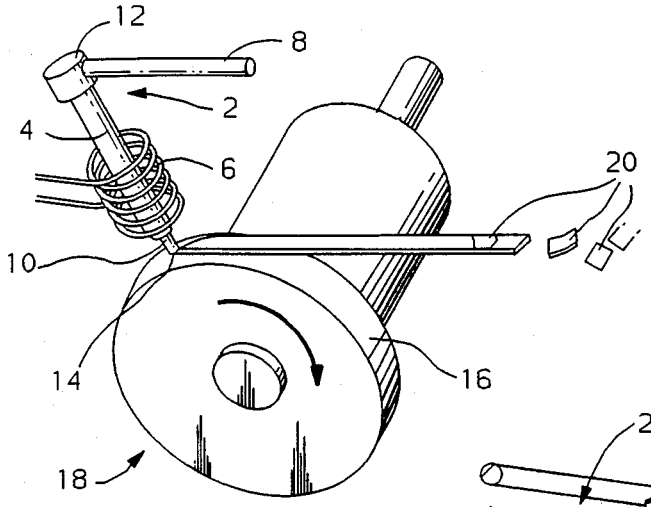
FIG. 1 is a diagrammatic view of a system for producing melt spun magnetically isotropic ribbon material of Nd-Fe-B alloy.
Figure 2:
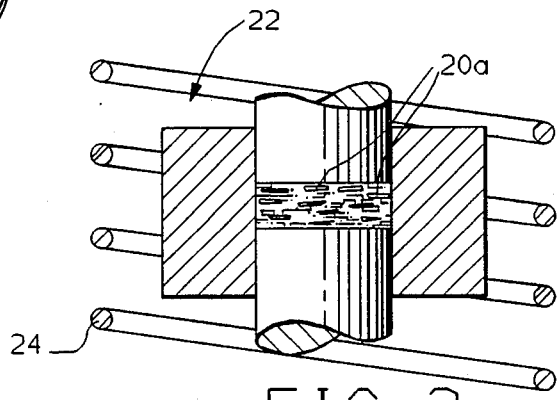
FIG. 2 is a cross-sectional view of a hot pressing die for compressing the isotropic ribbon material to a fully dense state.

Suitable compositions can be made by melt spinning apparatus 2 as shown in FIG. 1. The Nd-Fe-B starting material is contained in a suitable vessel, such as a quartz crucible 4. The composition is melted by an induction or resistance heater 6. The melt is pressurized by a source 8 of inert gas, such as argon. A small, circular ejection orifice 10 about 500 microns in diameter is provided at the bottom of the crucible 4. A closure 12 is provided at the top of the crucible so that the argon can be pressurized to eject the melt from the vessel in a very fine stream 14.

The molten stream 14 is directed onto a moving chill surface 16 located about one-quarter inch below the ejection orifice. In examples described herein, the chill surface is a 25 cm diameter, 1.3 cm thick copper wheel 18. The circumferential surface is chrome plated. The wheel not cooled since its mass is so much greater than the amount of melt impinging on it in any run that its temperature does not appreciably change. When the melt hits the turning wheel, it flattens, almost instantaneously solidifies and is thrown off as a ribbon 20 or ribbon fragments. The thickness of the ribbon 20 and the rate of cooling are largely determined by the circumferential speed of the wheel. In this work, the speed can be varied to produce a desired fine grained ribbon for practicing the present invention.

The cooling rate or speed of the chill wheel preferably is such that a fine crystal structure is produced which, on the average, has $Re_2TM_{14}B$ grains no greater than about 500 nm in greatest dimension.

SUMMARY OF THE PRIOR ART

A fully dense isotropic magnet formed from ribbon alloy broken into coarse size powder particles 20*a*, on the order of 150 μm, may be precompacted to full density. The particles 20*a* are placed in a preheated high temperature die 22. The die 22 is heated by an induction heater 24 in vacuum or an inert atmosphere. Uniaxial pressure is applied when the particles are heated. A preform results having full density. A suitable high temperature press process has time, temperature and pressure which produces sufficient plasticity for full densification.

Figure 3:
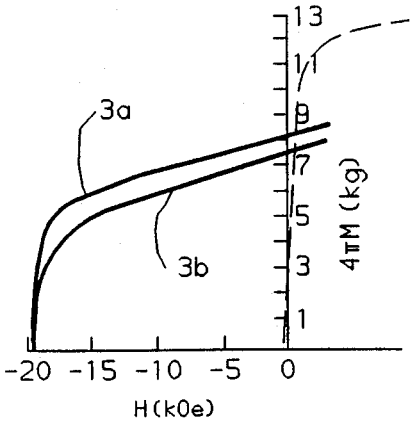
FIG. 3 is a second quadrant, room temperature, $4\pi M$ versus H plot of a sample produced by the FIG. 2 press.

The preform has typioal room temperature characteristics shown in FIG. 3. Curve 3*a* therein shows room temperature demagnetization characteristics of the particles in a direction parallel to the press direction. Curve 3*b* shows the room temperature demagnetization characteristics in a direction perpendicular to the press direction. While the material is substantially isotropic, it has a slight magnetic alignment in the press direction.

Figure 5:
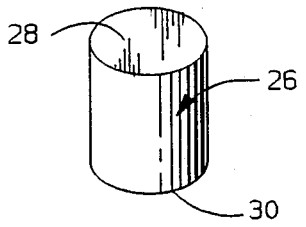
FIG. 5 is perspective view of a standard precursor of substantially isotropic permanent magnet material used in hot press die upsetting methods.
Figure 7:
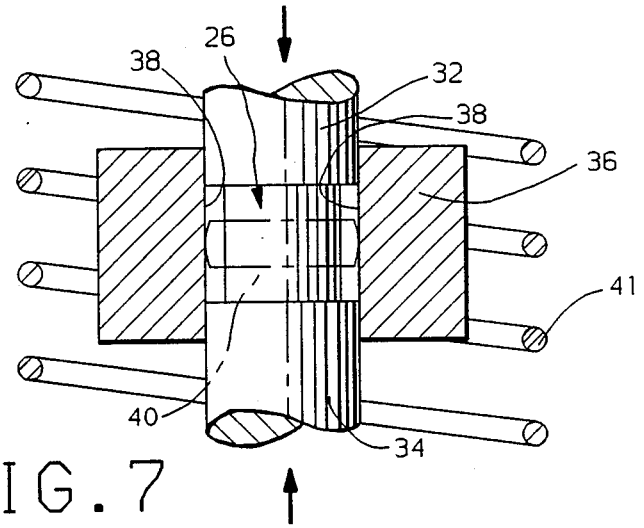
FIG. 7 is a diagrammatic view of the standard precursor in a hot press die before and after compression of the precursor.

Such starting material may be formed as a right circular cylindrically shaped standard precursor 26 as shown in FIG. 5. Such a standard precursor 26 has opposite ends 28, 30 thereof engaged by hot upset plungers 32, 34 of hot upset die apparatus 35. The plungers 32, 34 are driven into a die cylinder 36 to compress the precursor 26 to conform to the walls 38 thereof. The plungers 32, 34 compress the precursor 26 to a precursor resultant 40 having the shape shown in broken outline in FIG. 7. In this example, the standard precursor 26 has a diameter of 13 mm and a height of 13 mm. The die cylinder diameter is 16 mm and the compressed precursor 40 has a height of 6 mm and a diameter of 16 mm.

Figure 4:
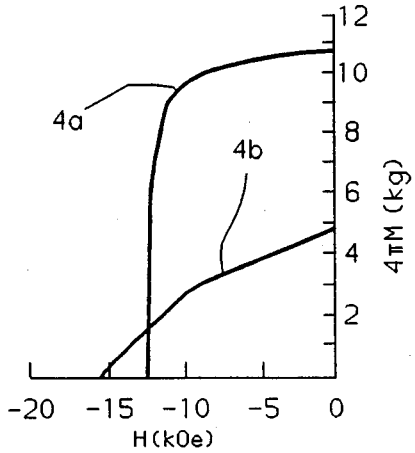
FIG. 4 is a second quadrant, room temperature $4\pi M$ versus H plot of a hot die-upset cylindrical precursor.

In the past, preforms of such precompacted material have been placed in a hot press upset die apparatus 35 of a diameter greater than that of the preform. Such apparatus compresses the preform to conform to the die shape under elevated temperature conditions produced by an induction heater 41. In this case, crystallites are strained and oriented along a crystallographically preferred magnetic axis with a resultant production of magnetically anisotropic material having higher value magnetic energy products than in the parent isotropic material as shown in FIG. 4. Curve 4*a* therein shows room temperature demagnetization characteristics of hot worked material in a direction parallel to the hot upset press direction. Curve 4*b* shows room temperature demagnetization characteristics of the hot worked material in a direction perpendicular to the hot upset press direction.

While FIG. 4 indicates an improved alignment of particles, in practice it has been observed that a substantial, volume percentage of the precursor resultant 40 does not develop high energy products. This effect is attributed to undesirable metal flow patterns caused by substantial friction effects at the interface between the plungers 32, 34 and the precursor 26. Such friction effects prevent lateral deformation at the ends of the precursor and through a portion of the axial length thereof and results in a barreling effect shown in FIG. 6. Such barreling is an exemplar of unsuitable metal flow which can reduce the volume fraction of the precursor resultant in which the material becomes oriented on a desired crystallographically preferred magnetic axis.

Figure 6:
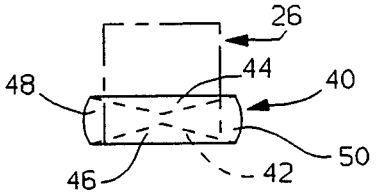
FIG. 6 is a diagrammatic view of a barreling effect produced in the standard precursor as it is compressed during hot press die upsetting.

More specifically, FIG. 6 shows that only a small central region 42 of the precursor 40 is free of such lateral restraint. Lateral deformation at each end of the precursor 26 adjacent to the surfaces of the plungers 32, 34 is restrained by the tool friction so that the spread of the material is constrained at the ends of the precursor 26 and barreled at the midsection thereof. The result is a pair of cone shaped zones 44, 46 in the compressed precursor 40 which are deformed to a lesser degree than the material in free flow barreled zones 48, 50 on either side of the central region 42. The barreling is, of course, limited by the inside diameter of the wall 36. As the precursor is compressed from the original height (broken outline) shown in FIG. 6 to the compressed height the zones 44, 46 are more resistant to deformation than the free flow zones 48, 50. Consequently, the material adjacent to the plungers is not subject to the same strain as at the middle or central region 42.

Figure 8:
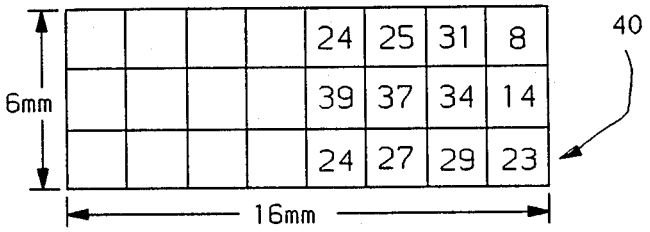
FIG. 8 is a chart of the distribution pattern of high energy products in a precursor resultant formed from the precursor of FIG. 5.

As shown in FIG. 8, only a small central region (approximately 5 volume %) of the precursor resultant reached maximum energy product levels in the order of BHmax of 40MGOe. The outer extremities of the compressed precursor resultant 40 have energy products which fall off to values less than 20MGOe.

Accordingly, there is a lesser volume fraction of the desired high energy products in the precursor resultant 40.

The following examples illustrate the practice of our invention.

Each such example demonstrates that adapting the precursor shape to a metal forming tool can promote higher lateral strain over a larger volume of precursor and thereby result in increased volume fractions of high energy products in a precursor resultant. As a variation of our invention, we also demonstrate (e.g. Example 1) that we can move the highest energy product regions from center to further out on the precursor resultant. In other words, we can choose where the maximum energy product regions occur.

In all of the following examples (as well as in the case of precursor resultant 40 above), room temperature demagnetization loops were measured in the press direction on cube segments of the precursor resultant. The examples demonstrate that adaptively shaped precursors of fully dense isotropic permanent magnet material with a Nd-Fe-B phase, can promote higher lateral strain over increased percentages of the volume of the precursor resultant so as to produce desired results. Specifically, the desired results are an increased percentage of high energy products in the precursor resultant due to improved alignment of grains of the Nd-Fe-B phase in a preferred direction transverse to the press direction. As previously discussed such alignment is along a crystallographically preferred magnetic axis which produces the resultant high energy product material.

In all of the examples, a preform of fully dense substantially isotropic permanent magnet material is shaped to have a height to diameter ratio less than 3:1 which will prevent buckling of the precursor as it is pressed into a reduced height configuration. Further, the precursor is adaptively shaped to provide compression relief that will improve lateral flow of the precursor to overcome metal flow patterns that otherwise inhibit equal lateral stain over increased volume fractions of the precursor resultant.

EXAMPLE 1

Figure 9:
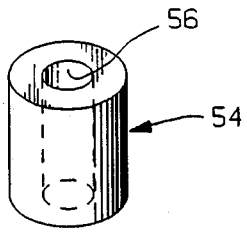
FIG. 9 is a perspective view of one embodiment of the invention shown as a precursor adaptively shaped as a donut.
Figure 10:
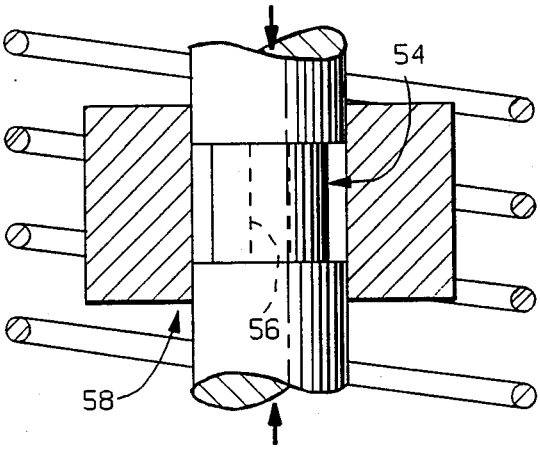
FIG. 10 is a cross-sectional view of a hot working die used to hot work the precursor of FIG. 9.

Fully dense, isotropic magnet material is shaped as a donut 54 (precursor) as shown in FIG. 9. The outer diameter of the donut is 14 mm and the height of the donut is 14 mm. The central hole 56 has a diameter of 8 mm. The hot upset die cylinder has a diameter of 16 mm.

Figure 11:
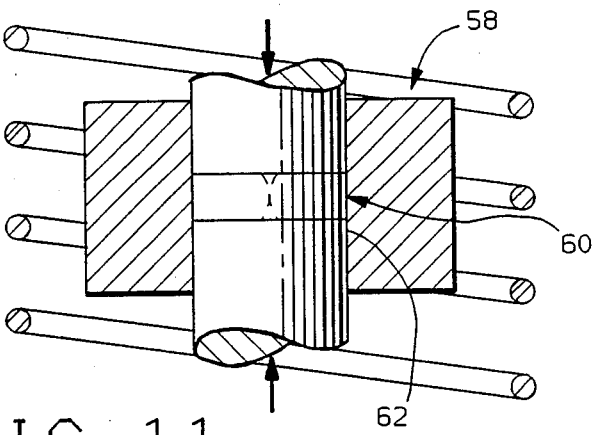
FIG. 11 is a cross-sectional view of the die and preform of FIG. 10 after hot working the precursor.

The donut 54 is die upset in a heated cylindrical upset die 58 to one half of its original height to produce a precursor resultant shown at 60 in FIG. 11.

Figure 12:
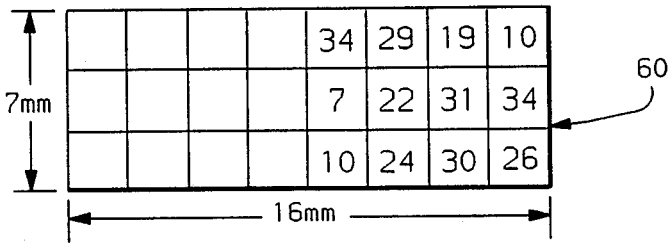
FIG. 12 is a chart of the distribution pattern of high energy products in a precursor resultant formed from the donut preform of FIG. 9.

The precursor resultant 60 has an improved smoothness at the outer surface 62 thereof. A volume fraction of 16% greater than 33MGOe was attained in the precursor resultant 60. The demagnetization curves of measured cubes had the energy product distribution as shown in FIG. 12.

In contrast to the preform of the first example the donut shaped preform provides a compression relief space at the center thereof to adaptively conform the precursor to a hollow die cylinder to produce predictable particle alignments in a preferred direction parallel to the press direction. While the total gain in the volume fraction of high energy product is less than in other examples to follow, it affords the advantage of predictable particle flow and an improved surface finish which may be of value in the production of certain kinds of finished permanent magnet products. It also produces higher energy products near the circumference but at the expense of lower energy product values in the volume center—a desirable configuration in some magnet geometries.

EXAMPLE 2

Figure 13:
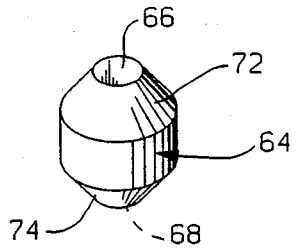
FIG. 13 is a perspective view of another embodiment of an inventive precursor adaptively shaped as a right circular cylinder having frustoconical ends.
Figure 14:
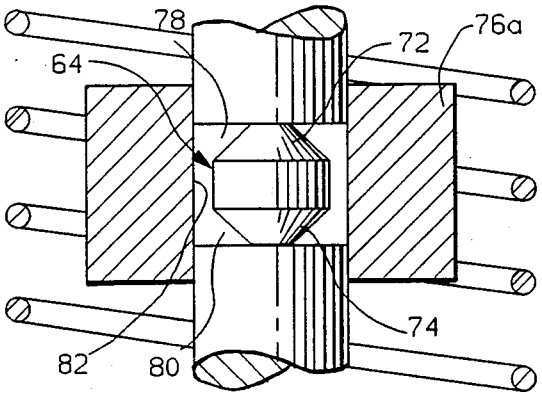
FIG. 14 is a cross-sectional view of a hot press upset die including the precursor of FIG. 13.

FIG. 13 shows a fully dense, isotropic magnet preform 64 adaptively shaped by removing material from the upper and lower ends 66, 68 of a right circular cylindrical part (like 26 in FIG. 5) to form frustoconical segments 72, 74 thereon. The precursor 64 is hot worked in a heated cylindrical upset die 76 shown in FIG. 14. The maximum diameter of the preform is 13 mm and the interior diameter of the die cylinder 76*a* is 16 mm. The arrangement provides toroidally shaped compression relief spaces 78, 80 adjacent the frustoconical segments 72, 74. The precursor material expands into the spaces 78, 80 without restraint to conform with the wall 82 of the die cylinder 76a. Such relief provides a uniform lateral flow of the precursor as it is compressed, resulting in even greater percentages of high energy product in the precursor resultant.

Figure 15:
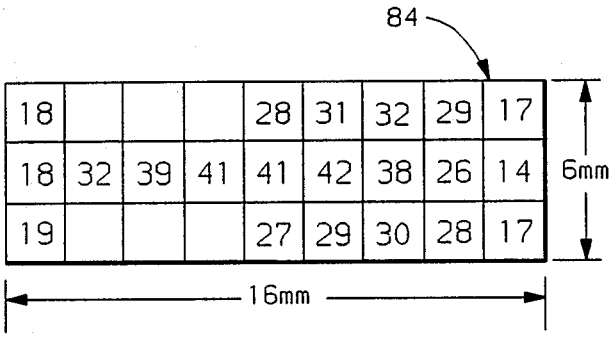
FIG. 15 is a chart of the distribution pattern of high energy products in a precursor resultant formed from the precursor of FIG. 13.

Specifically, as shown in FIG. 15, high energy product values occur at both ends of a compressed precursor resultant 84 to define an anisotropic permanent magnet with a high volume fraction of Nd-Fe-B type magnetically aligned ribbon particles. A volume fraction of 30% greater than 38MGOe was attained in the precursor resultant 84. Such increased volume fraction reflects increased ribbon alignment along the press direction from side to side of the compressed precursor in deformation patterns which are more uniform than in standard precursors subject to metal flow restraints.

EXAMPLE 3

Figure 16:
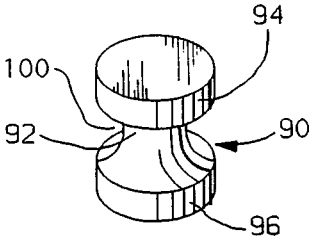
FIG. 16 is a perspective view of another embodiment of an inventive precursor adaptively shaped as a right circular cylinder having an hour glass shaped center region.

Another embodiment of the present invention is shown in FIG. 16 as a precursor 90 having an hour glass shaped center segment 92 formed between generally flat circular discs 94, 96 at either end of the precursor 90.

The precursor 90 is hour glass shaped from a right circular cylinder preform (like 26 in FIG. 5) by controlled etching of the central girth 100 of the cylinder in 50% $HNO_3$.

Figure 17:
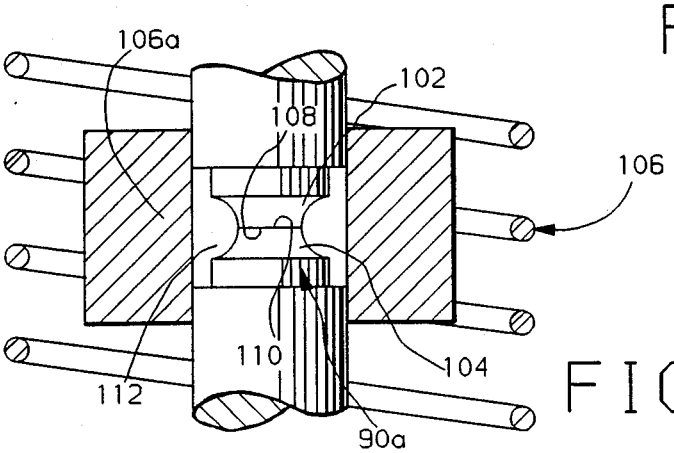
FIG. 17 is a cross-sectional view of a hot press upset die including the precursor of FIG. 16.

Alternatively, as shown in FIG. 17, a precursor 90a is defined by two generally conical portions 102, 104, each having their smaller diameter flat surfaces 108, 110 in contact at the mid-line of the precursor. The precursor 90a is shown mounted in a hot upset die 106 prior to upsetting The precursor 90 in this example is dimensioned to have a height of 13 mm and a maximum end diameter of 13 mm. The hour glass shape has a height of 7 mm and a minimum center diameter of 7 mm. It is placed in a hollow die cylinder 106a of 16 mm and is heated to a temperature and pressure of 750° C. and 75 MPa and die-upset 60% in height by die plungers.

An annular compression relief space 112 of a hemispherical like cross-section is provided between the die cylinder 106a and the precursor 90a for allowing uniform deformation thereof during hot die upsetting.

Figure 18:
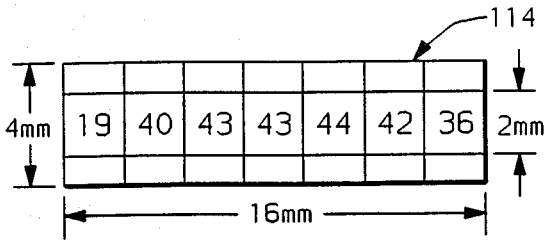
FIG. 18 is a chart of the distribution pattern of high energy products in a precursor resultant formed from the preform of FIG. 16.

The precursor resultant 114 in FIG. 18 is formed by a substantially unrestrained plastic metal flow.

The resulting demagnetization values of the precursor resultant 114, shown in the chart of FIG. 18, reflect a commensurate increase in maximum energy product which in this example produced a volume fraction of 35% of the precursor resultant having energy products greater than 40MGOe.

This example has a reverse metal flow pattern in that the central volume of the precursor compensates for the metal flow restraint problems previously discussed.

The following example of adaptive shaping is provided to accommodate a wider variety of final magnet product shapes.

EXAMPLE 4

This example includes an adaptively shaped precursor suited for production of permanent magnetically anisotropic magnets of both circular and rectangular shapes.

A precursor 120 is formed from a plurality of individual discs 122 having a height to diameter ratio less than 3:1 which will prevent buckling of the precursor during hot upsetting thereof.

A right circular cylinder of isotropic permanent magnet material with an intermetallic phase of Nd-Fe-B is sliced into 5 disks. Alternatively, one may start with thin discs pressed as such. The discs 122 are restacked and loaded into a hollow die cylinder 124 and hot pressed at 750° C. and 75 MPa by plungers 125 and an induction heater 127. The individual discs have an initial height of 3 mm; the stacked discs have a total initial height of 15 mm and a diameter of 10 mm. The die cylinder 124 has an inside diameter of 16 mm. The dimensional relationships result in a reduction in height of the stack of 64% when the stack is fully hot upset.

Figure 19:
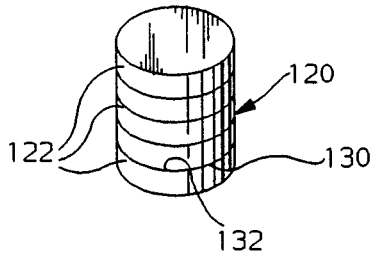
FIG. 19 is a perspective view of another embodiment of an inventive precursor adaptively shaped as a plurality of right circular cylinder discs having a height to diameter ratio to prevent buckling.
Figure 20:
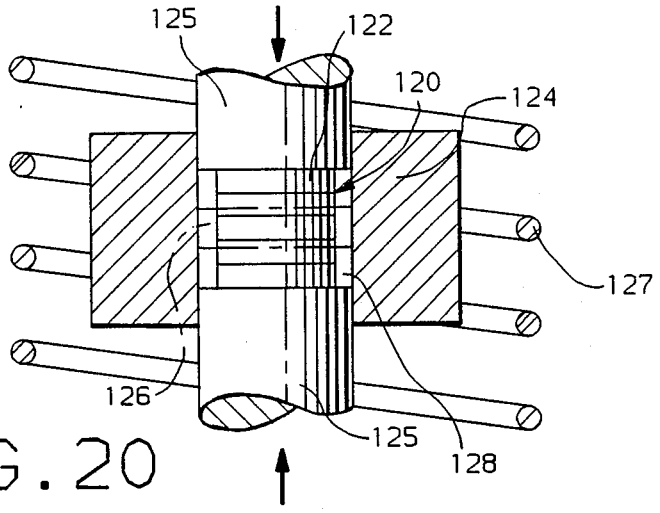
FIG. 20 is a cross-sectional view of a hot press upset die including the precursor of FIG. 19.

A precursor resultant 126 (shown in broken outline in FIG. 20) is fully dense and completely fills a hollow cylindrical compression relief space 128 formed between the stacked discs 122 and the inside wall of the cylinder 124. It has been observed that a high Nd content phase (93% Nd) becomes molten and migrates to the exterior juxtaposed end surfaces 130, 132 of the discs 122 (two such surfaces are identified in FIG. 19). The migrated molten phase acts as a natural lubricant to prevent frictional restraint of the lateral flow of material and consequently more uniform deformation of the ribbon layers is achieved.

Energy products of equal to or greater than 40MGOe were measured in a volume fraction of 48% of the precursor resultant 126. Cubes made from the end surfaces of the precursor resultant 126 (50 mg cubes) were also found to have reasonably uniform ribbon deformation with energy products of 25MGOe or greater.

The aforesaid precursor shape and method of manufacture is specially suited to the manufacture of magnets of complex shapes with a variety of cross-sections including triangles, squares, rectangles or other shapes. The use of the stacked disc precursor configuration produces desired uniform deformation which is a function of the ratio of the surface areas of the precursor 120 and the surface area of precursor resultant 126.

Figure 21:
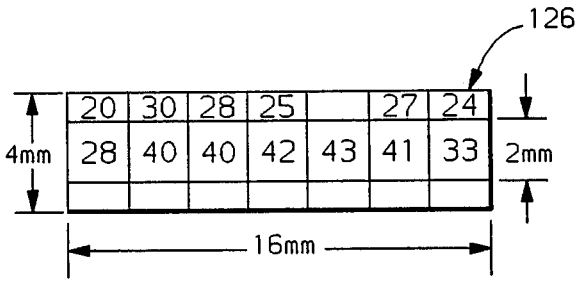
FIG. 21 is a chart of the distribution pattern of high energy products in a precursor resultant formed from the precursor of FIG. 19.

The improved distribution of high energy product is shown in the chart of FIG. 21.

SUMMARY

The aforesaid examples are select exemplars of the invention. It is clear that other precursor shapes are possible which will provide a desired compression relief space for the flow of metal to overcome unsuitable metal flow patterns.

An advantage of the present invention is that magnetically anisotropic ermanent magnets can be formed in a final shape without resorting to finish machining. Moreover the precursor resultant will have a high percentage of properly aligned particles therein to increase the high energy product content either in predictable regions of the finished product or more uniformly through the body of the finished product.

While our invention has been described in terms of specific embodiments thereof, other forms may be readily adapted by those skilled in the art. Therefore, our invention is to be limited only in accordance with the following claims.

The embodiments of the invention in which an exclusive property or privilege is claimed are defined as follows:

1. In a method of processing magnetically isotropic alloy material based on rare earth elements, iron and boron to make magnetically anisotropic material and wherein the magnetically isotrpic alloy material includes fine grained crystalline material having grains of $RE_2TM_{14}B$ where RE is one or more rare earth elements at least sixty percent of which RE is neodymium and/or praseodymium, TM is iron or iron-cobalt combinations and B is the element boron the improvement comprising;

precompressing particles of magnetically isotropic material to form a fully dense preform;

shaping the preform to form a precursor having compression relief regions therein or defined therewith when said precursor is placed in a hot-working die;

and hot working the precursor to flow the material of the precursor to fill the compression relief regions while maintaining the precursor at an elevated temperature as the precursor is being conformed to a hot working tool thereby to align particles or cyrstallites along a common crystallaographically preferred magnetic axis to increase the high energy product fraction of the total volume of a precursor resultant.

2. In the method of claim 1, precompressing the particles as a plurality of generally equidiameter disks having compression relief regions therebetween;

and hot working a stack of said discs arranged in the shape of a right cylinder by applying compression forces thereagainst so as to reduce the height of the discs while causing the outer surfaces thereof to expand uniformly in a die having a lateral dimension greater than the greatest lateral dimension of the disc and compressing the discs to cause the lateral dimension thereof to correspond to that of the die.

3. In the method of claim 2, providing a high Nd content grain boundary base in the fully dense preform;

and maintaining a hot pressing temperature to cause said Nd phase to diffuse to the exterior surfaces of said discs so as to form an in situ lubricant between the discs thereby to produce uniformity of deformation therein during compression thereof.

4. In the method of claim 1, shaping a preform of dense magnetically isotropic NdFeB material to form a precursor in the shape of a right circular cylinder;

slicing the precursor into a plurality of discs;

restacking the plurality of discs to locate end surfaces thereon in juxtaposed relationship within a die cavity of a diameter greater than that of said discs;

and hot pressing the discs to conform to the die cavity so as to uniformly deform and strain the discs to orient particles of the magnetically isotropic material along a crystallographically preferred magnetic axis to form a magnetically anisotropic precursor resultant.

5. In the combination of claim 4, hot pressing the restacked discs at a temperature causing the high Nd content phase to become molten and migrate to the exterior surfaces of said discs including the juxtaposed end surfaces therebetween so as to provide an in situ lubricant between said discs for producing uniform deformation therein and a maximum deformation over 50 percent of the total volume of said discs.

6. In the combination of claim 1, shaping the preform by removing material at surface regions thereon between the opposite ends thereof to form a precursor having unrestrained lateral material flow between the surface regions and a hot working tool.

7. In the combination of claim 6, shaping the preform to form an hour glass precursor configuration between opposite ends thereof and placing the precursor in a hollow containment cylinder and hot working the precursor to fill the cylinder while uniformly deforming the precursor to magnetically align the particles therein to increase the volume percentage of the high energy products therein.

8. In the combination of claim 7, forming the hour glass shape from two conical components each having a small diameter end and a large diameter end and wherein the small diameter ends are stacked with their surfaces in contact at a mid-line.

9. In the combination of claim 7, shaping the hour glass shaped precursor by etching a right circular cylinder at the center girth thereof.

10. In the combination of claim 6, shaping said preform to form a precursor having frustoconical ends thereon to provide said unrestrained lateral material flow between the precursor and the hot working tool.

* * * * *